United States Patent [19]

Brough et al.

[11] Patent Number: 4,719,771

[45] Date of Patent: Jan. 19, 1988

[54] APPARATUS FOR APPLYING LIQUIDS TO YARNS

[75] Inventors: Denys W. Brough; Christopher J. Lawrence, both of Macclesfield, England

[73] Assignee: Rieter Scragg Limited, Cheshire, England

[21] Appl. No.: 833,121

[22] Filed: Feb. 26, 1986

[30] Foreign Application Priority Data

Mar. 8, 1985 [GB] United Kingdom ..... 8506070

[51] Int. Cl.[4] ..... D06B 1/08

[52] U.S. Cl. ..... 68/200; 118/420; 118/DIG. 19; 137/577; 239/590.3

[58] Field of Search ..... 68/200; 8/151.2; 118/420, 429, DIG. 19; 239/590.3; 137/577

[56] References Cited

U.S. PATENT DOCUMENTS

| | | | |
|---|---|---|---|
| 1,219,265 | 3/1917 | Denhard | 137/577 X |
| 1,651,167 | 11/1927 | Van Alstyne et al. | 68/200 |
| 2,618,511 | 11/1952 | Wahlin | 239/590.3 |
| 2,678,024 | 5/1954 | Kresse | 68/200 X |
| 2,690,764 | 10/1954 | Hoffmann | 137/577 X |
| 2,892,336 | 6/1959 | Pensotti | 8/151.2 X |
| 2,976,177 | 3/1961 | Warthen | 118/420 X |
| 3,023,729 | 3/1962 | Hayden et al. | 118/234 |
| 3,274,985 | 9/1966 | Traver et al. | 137/577 X |
| 3,648,650 | 3/1972 | Joy | 118/123 |
| 3,981,324 | 9/1976 | Waring | 137/577 X |
| 4,051,807 | 10/1977 | Graf et al. | 118/401 |
| 4,082,225 | 4/1978 | Haynes | 239/590.3 X |
| 4,255,473 | 3/1981 | Williams, Jr. | 427/445 |
| 4,268,550 | 5/1981 | Williams, Jr. | 118/420 X |
| 4,329,750 | 5/1982 | Binnersley | 8/151.2 |
| 4,457,034 | 7/1984 | Simmen | 68/200 X |

FOREIGN PATENT DOCUMENTS

| | | |
|---|---|---|
| OS2045142 | 3/1971 | Fed. Rep. of Germany . |
| BE670879 | 5/1964 | France . |
| 2072054 | 1/1981 | United Kingdom . |

*Primary Examiner*—Philip R. Coe

*Attorney, Agent, or Firm*—Oblon, Fisher, Spivak, McClelland, & Maier

[57] ABSTRACT

Apparatus for applying liquid to a running yarn in a textile machine comprises a hollow body providing a manifold for the liquid and an elongate tube extending horizontally across the manifold. The tube is retained in a bore in the body by a yarn guide which is detachably secured to the body and the bore in the tube communicates with a groove yarn path provided by the yarn guide via a bore in the yarn guide of larger diameter than the bore in the tube. The constant supply of liquid to the yarn is provided by the controlled flow of liquid along the tube whose length is at least 100 times the diameter of the bore therein. A height adjustable weir in a liquid supply tank supplies liquid to the manifold at a predetermined pressure. The yarn path has a plurality of yarn contact points to ensure complete application of liquid by the yarn.

20 Claims, 7 Drawing Figures

APPARATUS FOR APPLYING LIQUIDS TO YARNS

BACKGROUND OF THE INVENTION

This invention releates to apparatus for applying liquid to a yarn in a textile machine, and more particuarly to such apparatus which will apply the liquid at substantially the same, constant rate to each yarn in a multi-station yarn processing machine.

DESCRIPTION OF THE PRIOR ART

Devices of this type are well known. One such apparatus comprises an applicator head having a liquid reservoir whose upper surface has a slit therein through which the liquid passes to a yarn guided over the surface, the reservoir being supplied with liquid from a remote source. However variations in the pressure of the supply of liquid to the reservoir are readily transmitted to the yarn in the form of variations of liquid applications rate along the yarn. In addition if, as is customary, the yarn is travelling through the machine in a generally vertical path it must be deflected so as to pass over the abovementioned upper guide surface, thereby requiring extra yarn guides and causing increased yarn tension and the likelihood of damaged filaments and reduced tenacity.

In other known apparatus a liquid supply pipe extends horizontally along a plurality of spinning stations and has a groove for each yarn and a respective liquid outlet opening into each groove. However it is difficult to adjust the supply of liquid to the supply pipe to ensure a constant and equal liquid flow rate through each of the outlets.

To avoid the abovementioned disadvantages there is disclosed in DEOS 2045142 apparatus comprising a supply pipe and yarn guides thereon for each yarn, with outlets opening into each yarn guide, the supply pipe in this case being supplied by liquid which passes through a pressure governor provided on the supply pipe. The governor, in the form of a weir, is located downstream of the yarn guides and serves to build-up a hydrostatic pressure of predetermined value in the supply pipe. An alternative arrangement is disclosed in British Pat. No. 2079189. In this case costly flow regulation devices are required since the quantity of liquid fed to a supply tank is governed thereby. The supply tank feeds liquid to a supply pipe and yarn guides, and the flow rate to the supply tank is regulated to the flow rates through the outlets and is matched to the speed of travel of the yarns and their titre. In these apparatus the flow rate to each yarn is determined by the pressure head of liquid supplied to the yarn guides and the dimensions of the outlet apertures. It is therefore difficult to ensure that the outlet dimensions and head are constant on a machine and from machine to machine to ensure equal application of liquid to each yarn.

Other devices for applying liquids to yarns are described in U.S. Pat. Nos. 1934796 and 2678024. In the former case each yarn guide has a capilliary bore through which the liquid flows to the guide surface, and in the latter case each yarn passes over the top surface of a sponge whose lower part is immersed in the liquid, the liquid passing upwardly through the sponge by capilliary action. In another apparatus, as disclosed in British Pat. No. 1522543, each applicator head has a horizontal slit of adjustable width leading from a liquid supply pipe to a vertically disposed yarn guide edge.

The slit has a rough surface to aid the distribution of liquid in the slit. The provision of the bores, sponges or slits, along which the liquid travels by capilliary action, acts as a buffer against variations in the pressure of the supply of liquid to the supply pipe, thereby ensuring a more even application of liquid to the yarn than was the case with the previously described apparatus. Furthermore the yarn does not have to be deflected from its generally vertical path through the textile machine. However it is difficult to ensure that all of the bores, sponges or slits, in a multi-station textile machine incorporating many such applicator heads, are of equal dimensions and roughness in order to ensure that each yarn in the machine receives liquid at the same rate. It is an object of the present invention to provide apparatus for applying liquids to yarns which overcomes, at least to a substantial extent, the disadvantages of the previously described types of apparatus, as well as providing a simple but effective means for adjusting the rate of liquid application.

SUMMARY OF THE INVENTION

The invention provides apparatus for applying liquid to a yarn, comprising a hollow body providing a manifold for said liquid, liquid supply means in fluid flow connection with said manifold and operable to supply said liquid thereto at a predetermined pressure, a yarn guide providing a path for a yarn to pass in contact therewith, an elongate tube extending from said manifold to said yarn guide having a bore of a first diameter therealong, and a bore of diameter greater than said first diameter in said yarn guide communicating with said tube bore and said yarn path whereby the rate of flow of liquid to said yarn is determined by the rate of flow of liquid along said tube under said pressure. Said elongate tube preferably has a length of at least 100 times said first diameter, which length may be between 127 and 217 times said first diameter.

Said tube may be mounted within said body to extend in a substantially horizontal direction, and it may extend from one side of said body adjacent said yarn guide, across said manifold, and have a free open end adjacent the opposed side of said manifold.

Said yarn guide may be removably secured to said body, in which case said tube may be mounted in a bore provided in said body and communicating with said bore in said yarn guide. Said tube may be mounted in said body so as to be slidably removable therefrom and retained therein by said yarn guide. Preferably said tube is resiliently biassed outwardly of said body. Preferably sealing means is provided between said yarn guide and said body around said bore therein. Said yarn path may have a plurality of yarn contact points spaced therealong and said yarn guide may have a liquid flow channel operable to direct liquid from adjacent one yarn contact point to an adjacent yarn contact point.

Said liquid supply means may comprise a supply tank having weir means operable to provide a constant supply pressure or head of liquid above said manifold. Preferably the height of said weir means above said manifold, and hence said head, is adjustable. Said weir means may comprise a tube upstanding in said supply tank and extending through a base wall thereof into a liquid reservoir tank. A pump may be provided, being operable to pump liquid from said reservoir tank into said supply tank. A tray may be provided beneath said yarn guide and a liquid return pipe communicating with said tray and said reservoir tank.

The invention also provides a textile machine having such a liquid applying apparatus as aforesaid adapted to apply liquid to a plurality of yarns disposed at spaced intervals along said machine. Preferably said apparatus comprises a common body providing a common manifold extending along said machine. A single tank, pump and reservoir tank may be provided for said machine, operable to supply said common manifold and each of a plurality of yarn guides with liquid at said predetermined pressure.

BRIEF DESCRIPTION OF THE DRAWINGS

Embodiments of the invention will now be further described with reference to the accompanying drawings in which.

DETAILED DESCRIPTION OF THE PREFERRED EMBODIMENTS

Figure 1:
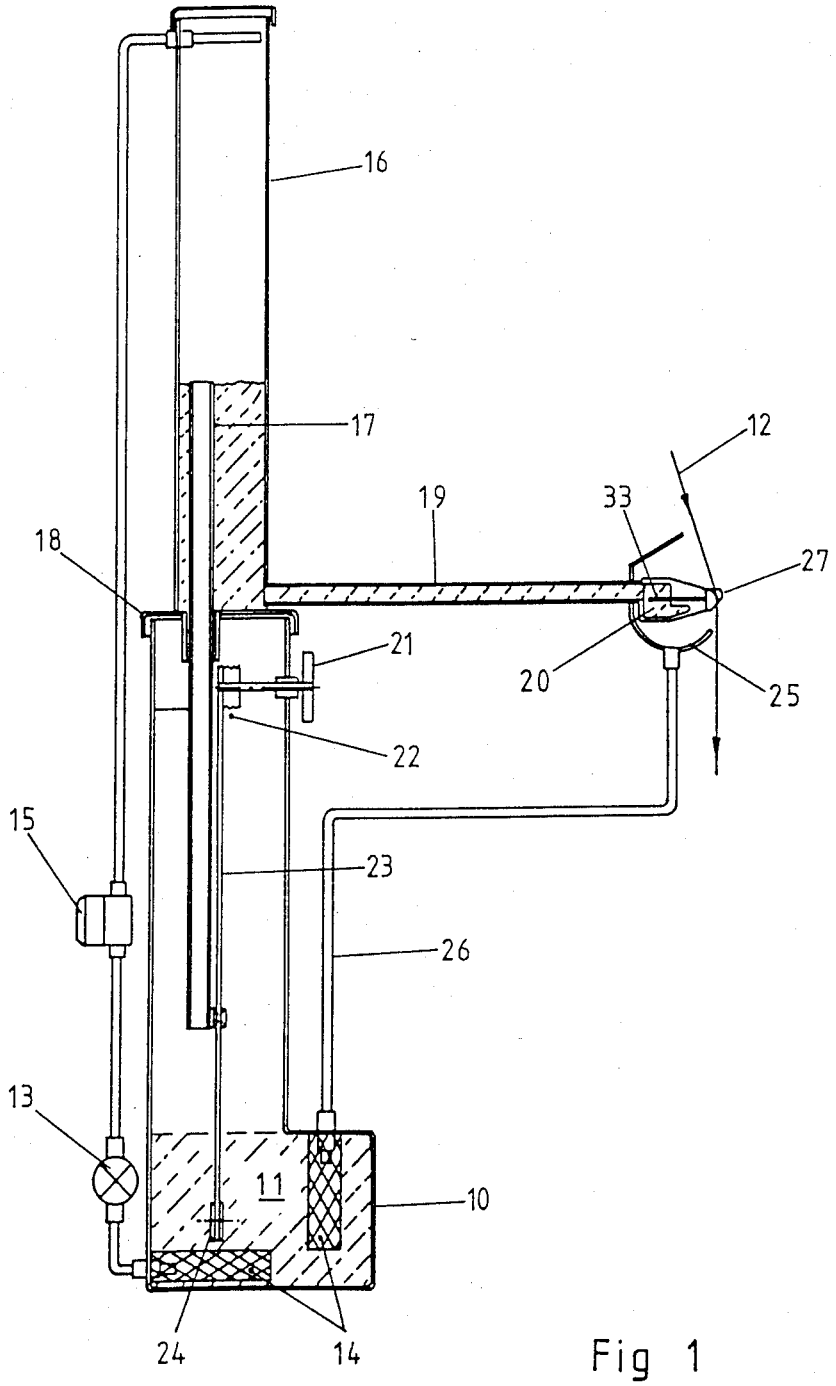
FIG. 1 is a schematic elevation of a first embodiment

Referring now to FIG. 1 there is shown a reservoir 10 for a liquid 11 to be applied to yarn 12. A pump 13 is operable to pump liquid from the reservoir 10 through a coarse filter 14 and a fine filter 15 to the top of a head tank 16. The head tank 16 is mounted above the reservoir 10 and a weir tube 17 passes through the base 18 of the head tank 16. A liquid supply tube 19 extends from the bottom of the head tank 16 to a manifold 20. The height of the top of the weir tube 17 above the manifold 20 may be adjusted by rotation of a knob 21 which is coupled to pulley 22. An endless cord 23 passes around pulley 22 and another pulley 24 and one run of cord 23 is attached to the bottom of weir tube 17. Alternatively a rack may be attached to the weir tube 17 and the pulley 22 may be replaced by a pinion which engages the rack, or any other height adjusting mechnaism may be used.

In a textile machine having a plurality of yarn processing stations disposed side-by-side along the machine one such apparatus as above described may be provided, the manifold 20 extending along the length of the machine. The manifold 20 is of such relatively large cross-sectional area in relation to the rate of uptake of liquid 11 by all of the yarns 12 that the rate of flow of liquid 11 along the maniford 20 is very low and the pressure loss therealong is negligible and may be ignored. In consequence the height of the top of the weir tube 17 above the manifold 20 may be taken as the static head of liquid 11 for each yarn processing station, and markings may be provided on or adjacent the knob 21 to indicate the static head. As long as the rate of liquid delivery by the pump 13 is greater than the rate of liquid uptake by the yarns 12, the liquid level in the head tank 16 will be maintained, the excess liquid therein overflowing through the weir tube 17 and returning to the reservoir tank 10.

A tray 25 extends along the machine beneath the manifold 20 and applicator head 27 to receive any liquid not taken up by the yarns 12, such liquid being returned to the reservoir 10 along a pipe 26 and through a coarse filter 14.

Figure 2:
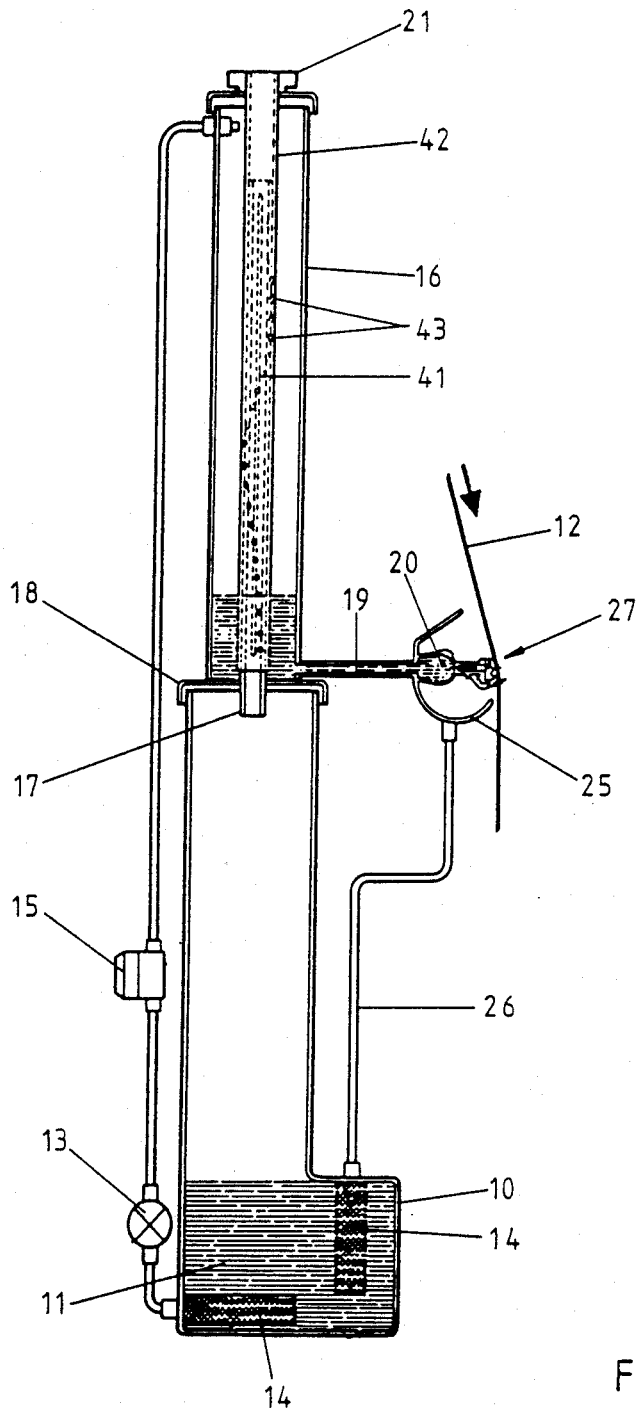
FIG. 2 is a schematic elevation of a second embodiment

In FIG. 2 there is shown an alternative embodiment of the above described apparatus, corresponding parts being designated with corresponding reference numerals. In this embodiment however the weir tube 17 is fixed in position and has an elongate slot 41 extending therealong. A second, coaxial tube 42 is rotatable on the weir tube 17 and has a plurality of holes 43 in a spiral formation therealong. Knob 21 is attached to tube 42 and rotation of knob 21 causes a selected one or more of the holes 43 to align with the slot 41 to thereby provide a weir at the desired height.

Figure 3:
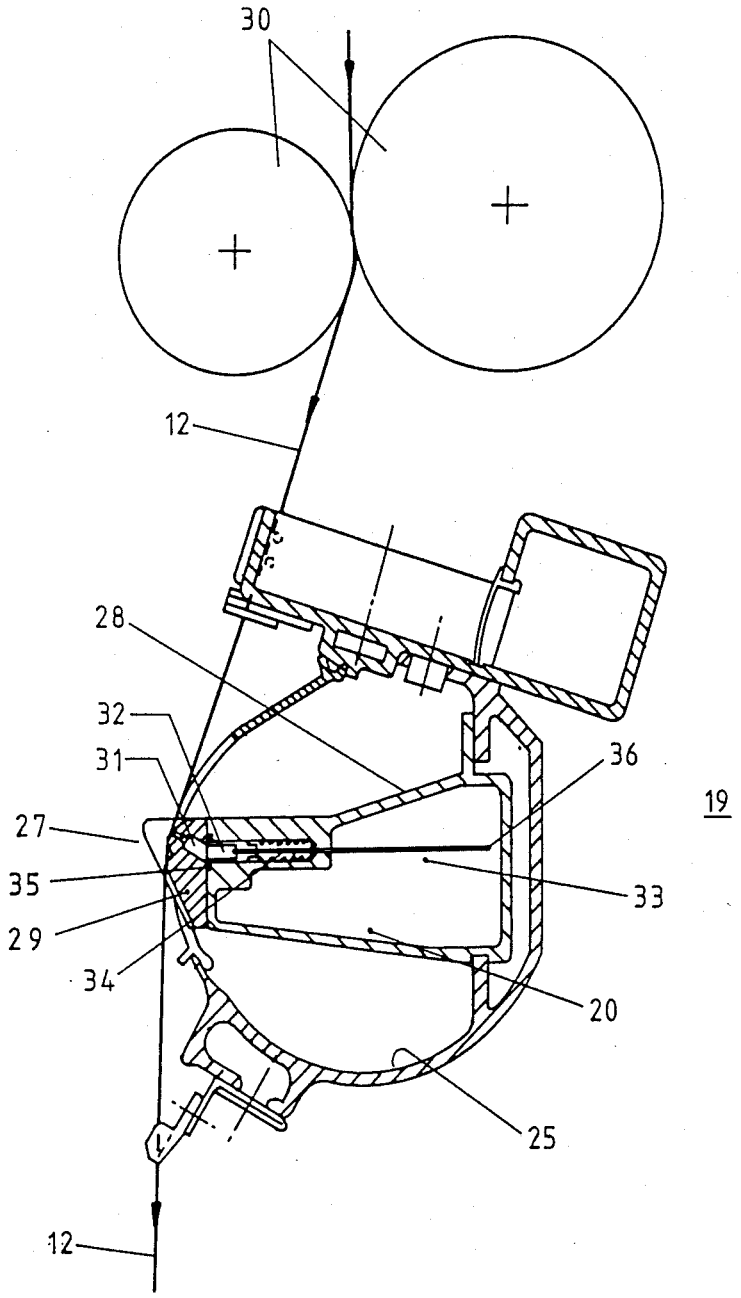
FIG. 3 is a sectional elevation of the applicator head of FIG. 1 to an enlarged scale

At each yarn processing station of the textile machine is an applicator head 27, of which a first embodiment is shown in greater detail in FIG. 3. The manifold 20 is formed in a composite body 28 which also provides the tray 25. Detachably secured to the body 28 at each yarn processing station is a yarn guide 29 over which the yarn 12 passes from feed rollers 30 to a take-up means (not shown). A bore 31 extends through the yarn guide 29, the yarn 12 passing across one end of the bore 31 and the other end of the bore 31 communication with a bore 32 provided in the body 28. Mounted in the bore 32 is a tube 33, which may be for example 65 mm in length and have a bore of between 0.51 mm and 0.3 mm. The tube 33 is biassed by a spring 34 outwardly of the body 28, but is retained therein by the yarn guide 29. An O-ring 35 is provided around the bores 31, 32 between the body 28 and the yarn guide 29 to prevent liquid leakage therebetween or by-passing the tube 33. The tube 33 extends in a substantially horizontal direction across the manifold 20, although the tube 33 may be inclined if desired, and has a free open end 36 at the end remote from the yarn guide 29. Liquid 11, which has been supplied to the manifold 20 through supply tube 19 can pass along each tube 33 and respective bores 32, 31 to be taken up by the respective yarn 12. Adjustment of the height of the top of the weir tube 17 above the manifold 20 controls the pressure of the liquid 11 in the manifold 20 and the rate of flow of liquid along the tubes 33. By this means the rate of liquid uptake by the yarns 12 can be carefully regulated, such rate of liquid flow and uptake being dependent on the length and diameter of the tube 33, the viscosity of the liquid and the static head. Tube dimensions to give desired flow rates at practical static heads are readily predicted using standard pipe flow theory, and such flow rates are readily achieved and accurately controlled with the apparatus as herein described. By not relying on capilliary flow criteria the tube dimension accuracy is not as critical as with the known apparatus which does rely on capilliary flow. In addition the tube 33 is less prone to blockage than the small dimensional capilliary flow types of apparatus.

Figure 4:
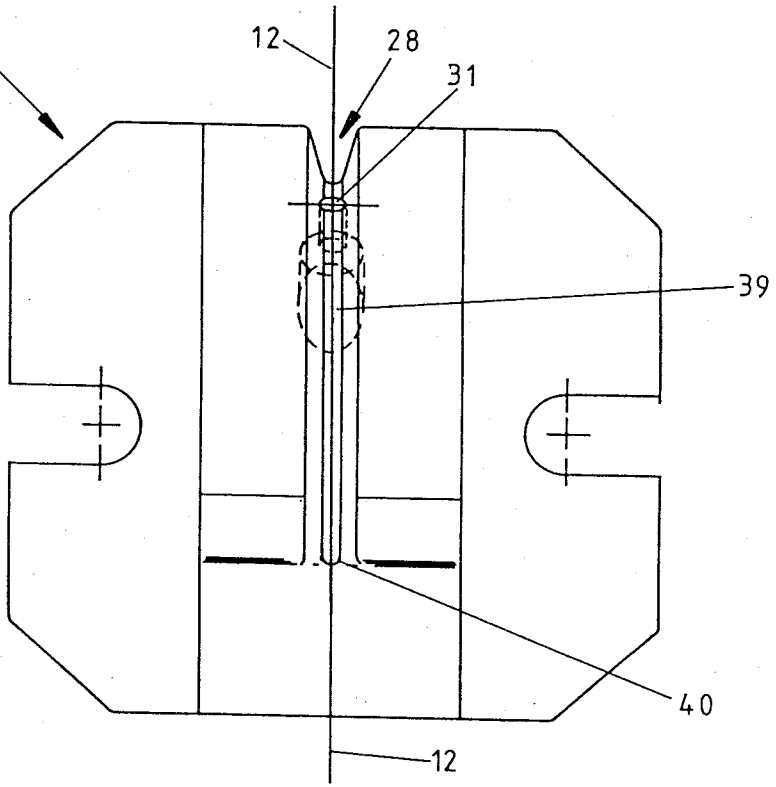
FIGS. 4 and 5 are front and side elevations respectively of the yarn guide of FIGS. 1 and 3 to a further enlarged scale
Figure 5:
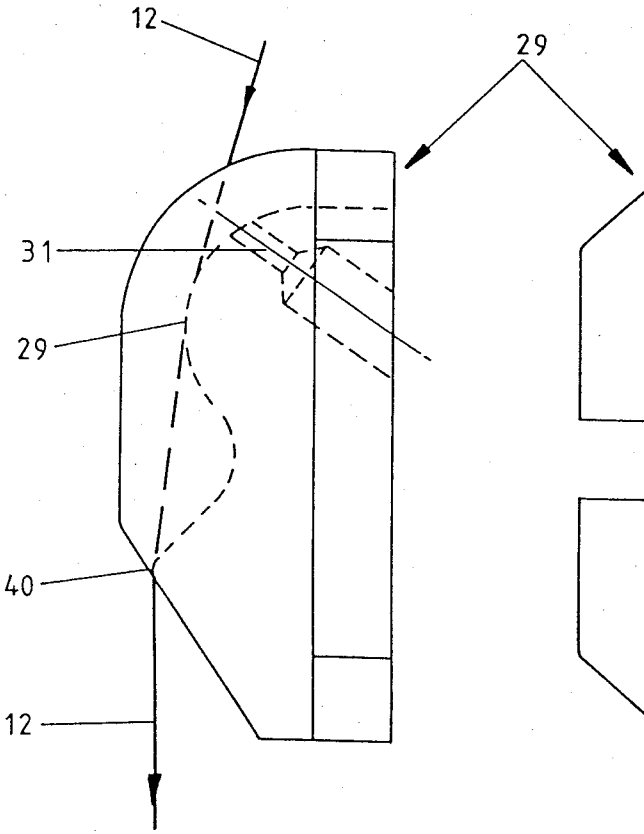

Referring now to FIGS. 4 and 5 there is shown the yarn guide 29 of FIGS. 1 and 3 in greater detail. The guide 29 has a groove 38 which provides the path for the yarn 12 along which path two yarn contact points 39, 40 are spaced. The bore 31 in the guide 29 terminates at the bottom of the groove 38, which, in the case of the downwardly travelling yarn 12 as shown, is just upstream of the upper yarn contact point 39 so that a substantial proportion of the liquid issuing from the bore 31 is picked up by the yarn 12. Any liquid not picked up by the yarn 12 at point 39 is guided by the walls of groove 38 to the lower yarn contact point 40 where it is picked up by the yarn 12. By this means little if any of the liquid escapes the yarn 12, and the desired flow rate used in the calculations of the dimensions of the tube 33 fairly accurately correlates with the amount of liquid actually applied to the yarn 12 in practice. Removal of the yarn guide 29 from the body 28 enables the tube 33 to be withdrawn from the manifold 20 in a simple and straightforward sliding manner, particularly in view of the fact that the free end 36 of the tube 33 does not have to be coupled to any form of supply pipe or other apparatus. The tube 33 can be replaced quickly by another tube, thereby minimising machine down time, and the removed tube cleaned at leisure ready for subsequent use. If the yarn 12 were to be travelling upwardly the bore 31 may terminate just below, at or just above the upper yarn contact point 39 and liquid not picked up at that point would drain to and be picked up a the lower yarn contact point 40.

Figure 6:
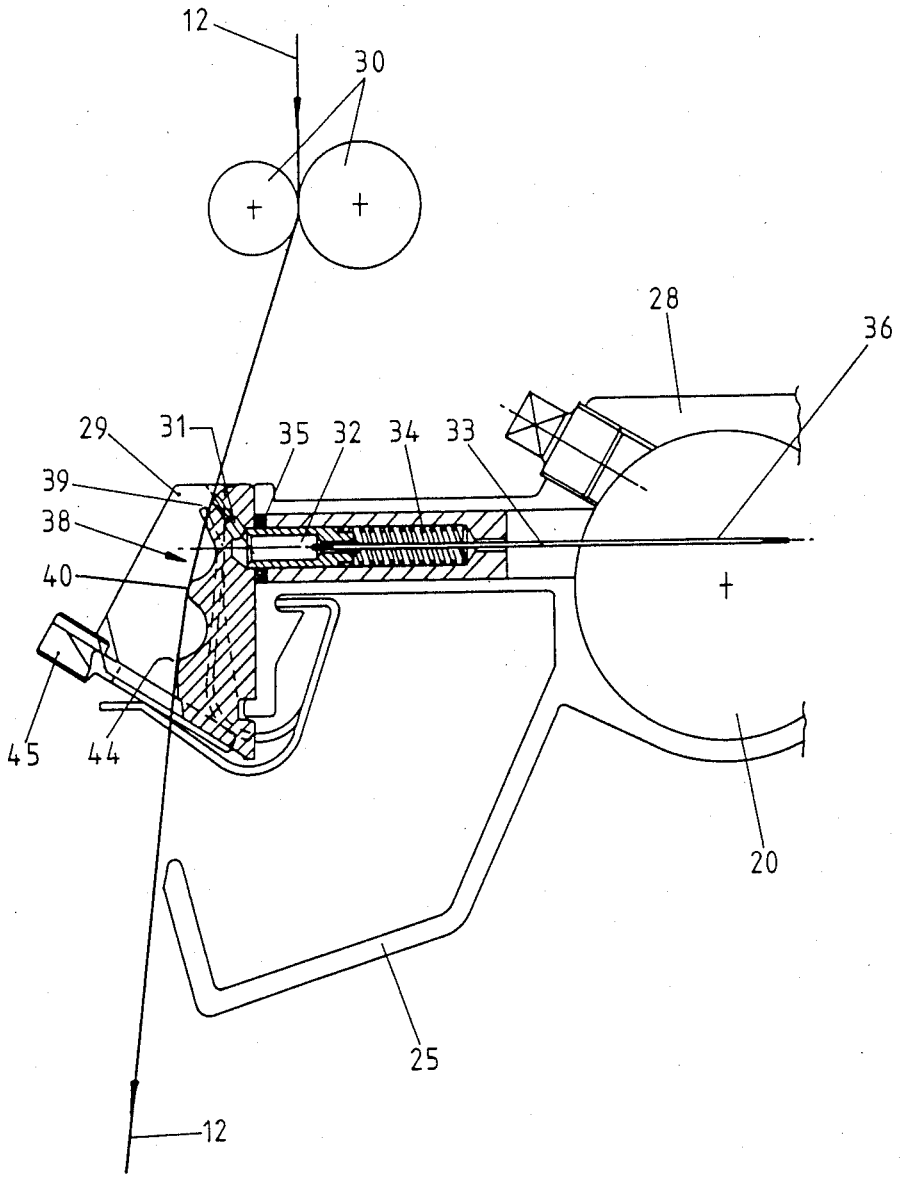
FIG. 6 is a sectional elevation of the applicator head of FIG. 2 to an enlarged scale.

In FIG. 6 there is shown an alternative applicator head 27 and yarn guide 29 to that shown in FIGS. 3 to 5, corresponding parts again being designated with corresponding reference numerals. Apart from the differing designs of the bodies 28 in the two cases, the principal difference between the two embodiments lies in the provision of three yarn contact points 39, 40, 44. Any liquid issuing from bore 31 and not picked up by the yarn 12 at yarn contact points 39, 40 is guided by the groove 38 to the third yarn contact point 44 where it is picked up by the yarn 12. More than three yarn contact points may be provided if desired, the bore 31 terminating adjacent the upper or an intermediate yarn contact point. A further guide 45 is provided, operable to guide the yarn 12 back into the groove 38 and in contact with the contact points 39, 40, 44 if it should inadvertently become displaced. This ensures that little if any of the running yarn 12 does not receive the correct quantity of liquid.

Figure 7:
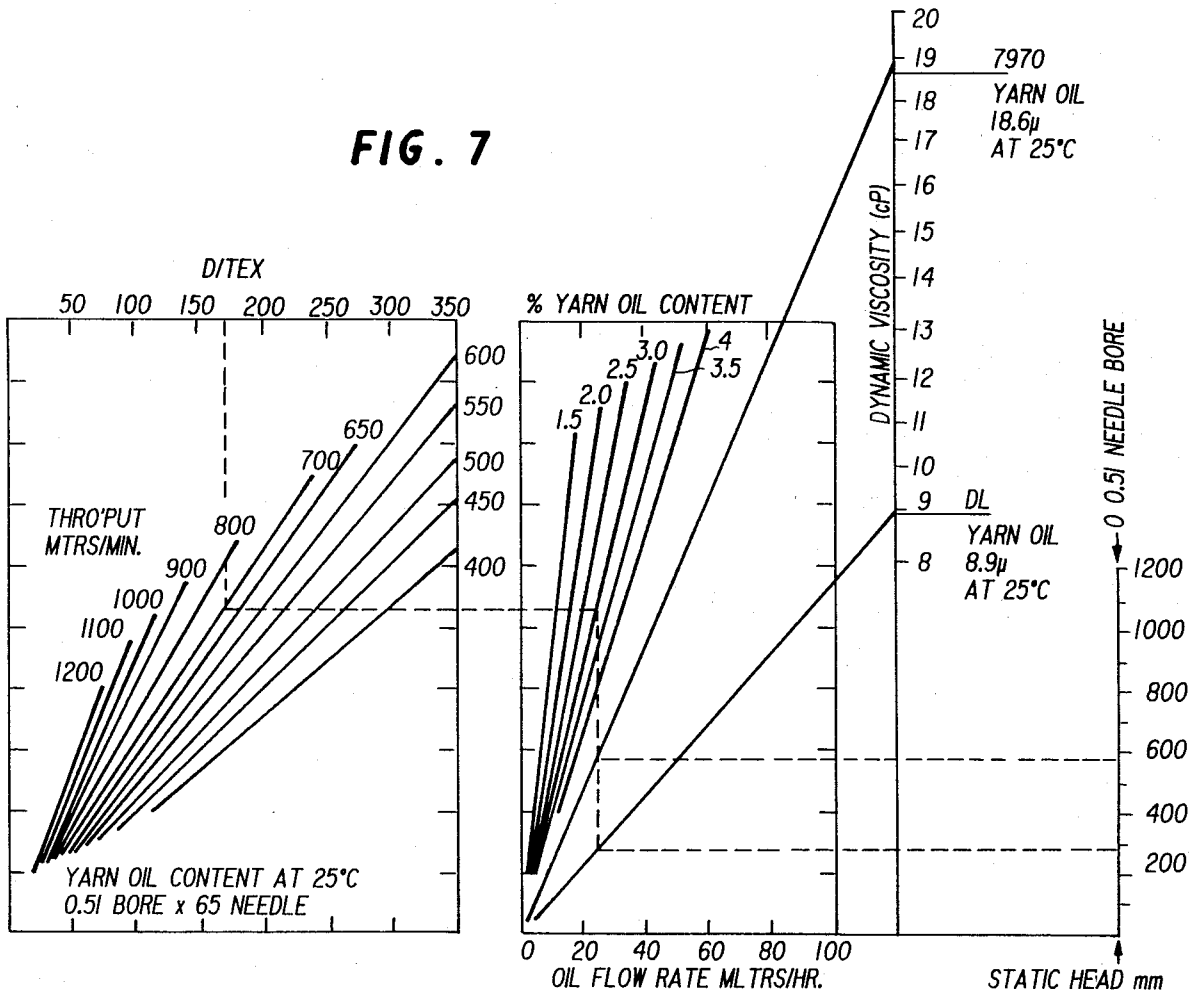
FIG. 7 is a nomogram showing static head required for differing yarn titres and throughput speeds, and differing liquid viscosities.

There is in FIG. 7 a nomogram of static head required for yarns of differing titre at differing yarn throughput speeds for differing liquid viscosities. The required static head, i.e. the height of the top of the weir tube 17 above the manifold 20, in the case of the FIG. 1 embodiment or the height of the slot-aligned hole 43 above the manifold 20 in the case of the FIG. 2 embodiment, may be determined as shown by the example in broken lines so as to give the appropriate oil flow rate for any specified yarn titre (e.g. 170 decitex), yarn throughput speed (e.g. 700 m/min), percentage oil content (e.g. 3%) and oil viscosities (e.g. 18.6$\mu$ and 8.9$\mu$ at 25° C.). The example shown is appropriate for the case of a tube 33 of 65 mm length and 0.51 mm internal diameter and is based on the standard pipe flow formula $h=128\mu QL/\eta D^4$ where h is the static head, $\mu$ is the liquid viscosity, Q is the flow rate, L is the tube length and D is the tube bore diameter. Similar nomograms for use with tubes of other lengths and/or diameters can be produced. Adjustment of knob 21 in accordance with the static head reading taken from the nomogram of FIG. 7 ensures that the required oil flow rate to each yarn 12 is achieved in a simple but effective manner. Liquid pressure variations throughout the apparatus are minimised and any fluctuations thereof are effectively isolated from the yarn guides 28 by use of the tubes 33.

The present system of applying oil to a yarn provides a more consistent oil flow at each yarn oiling position than was the case with previously known systems. In the apparatus of the present invention it is advantageous that the metering of the oil flow is controlled by the resistance to oil flow which occurs in a long tube of not too small a bore diameter, rather than by the resistance to flow by capilliary action which occurs in a relatively short tube or slit of relatively small dimensions. In the present case the dimensions of the tube are not excessively critical, whereas in the prior art case the fine bore or slit has to be produced extremely accurately for consistent position to position uniformity of flow, and unlike the tube of the present invention such fine bores or slits are easily blocked by minute debris. The present invention also has particular advantage in certain textile applications such as in texturing machinery which heretofore has used roller-lick oil application. In such cases it was required to remove the yarn from the oil applicator when doffing would packages in order to avoid the yarn wrapping around the roller due to its reduced tension whilst doffing. This cannot occur with the apparatus of the present invention.

We claim:

1. Apparatus for applying liquid to a yarn, comprising a hollow body, a manifold for said liquid in said body, liquid supply means in fluid flow connection with said manifold and operable to supply liquid thereto at a constant predetermined pressure, a yarn guide, a path for a yarn in said yarn guide for said yarn to pass in contact therewith, an elongate tube having a length substantially greater than the diameter thereof, extending from said manifold to said yarn guide, a bore of a first diameter in said elongate tube, and a bore having a minimum diameter greater than said first diameter in said yarn guide connecting said tube bore with said yarn path and providing a liquid flow path from said manifold solely to said yarn path, in which the rate of flow of liquid is determined by the rate of flow of liquid along said tube under said predetermined pressure.

2. Apparatus according to claim 1 wherein said elongate tube has a length of at least 100 times said first diameter.

3. Apparatus according to claim 2 wherein said elongate tube has a length of between 127 and 217 times said first diameter.

4. Apparatus according to claim 1 wherein said tube is mounted within said body so as to extend in a substantially horizontal direction.

5. Apparatus according to claim 1 wherein said body has opposed sides, one side being adjacent said yarn guide wherein said tube extends from said one side, across said manifold and has a free open end adjacent the opposed side of said manifold.

6. Apparatus according to claim 1 wherein said yarn guide is removably secured to said body.

7. Apparatus according to claim 1 wherein a bore is provided in said body, which bore communicates with said bore in said yarn guide, and wherein said tube is mounted in said bore in said body.

8. Apparatus according to claim 7 wherein said elongate tube is slidably removable from said body and is retained in said bore in said body by said yarn guide.

9. Apparatus according to claim 8 comprising resilient biassing means operable to bias said tube outwardly of said body.

10. Apparatus according to claim 7 comprising sealing means disposed between said yarn guide and said body around said bore therein.

11. Apparatus according to claim 1 comprising a plurality of yarn contact points which are spaced along said yarn path.

12. Apparatus according to claim 11 wherein a liquid flow channel is provided in said yarn guide, said liquid flow channel being operable to direct liquid from adjacent one yarn contact point to an adjacent yarn contact point.

13. Apparatus according to claim 11 wherein said bore in said yarn guide meets said yarn path adjacent and upstream of the first of said yarn contact points in the direction of travel of yarn.

14. Apparatus according to claim 1 wherein said liquid supply means comprises a supply tank and weir means including a weir, and is operable to provide a constant supply pressure or head of liquid above said manifold.

15. Apparatus according to claim 14 wherein the height of said weir provided by said weir means above said manifold is adjustable.

16. Apparatus according to claim 15 comprising a liquid reservoir tank, wherein said supply tank has a base wall and said weir means comprises a tube having an axis and being upstanding in said supply tank, said tube having an upper end providing said weir and extending through said base wall into said liquid reservoir tank.

17. Apparatus according to claim 16 wherein said tube is movable axially of itself to adjust the height of said upper end relative to said manifold.

18. Apparatus according to claim 16 wherein a slot is provide in said tube to extend therealong, and a second tube is coaxially disposed relative to said slotted tube, said second tube being rotatable relative to said slotted tube, and a plurality of holes are provided in said second tube disposed in a helical formation, whereby rotation of said second tube relative to said slotted tube caused at least a predetermined one of said holes to align with said slot and provide said weir.

19. Apparatus according to claim 16 comprising a pump operable to pump liquid from said reservoir tank to said supply tank.

20. Apparatus according to claim 16 comprising a tray disposed beneath said yarn guide, and a liquid return pipe communicating with said tray and said reservoir tank.

* * * * *